US008919769B2

(12) United States Patent
Zubarevich et al.

(10) Patent No.: US 8,919,769 B2
(45) Date of Patent: Dec. 30, 2014

(54) SELF-ADJUSTING PROCESSING SYSTEM FOR SHEET MATERIAL AND A PROCESSING METHOD USING SUCH SYSTEM

(75) Inventors: Sergei Zubarevich, St. Petersburg (RU); Ilgam Garipov, St. Petersburg (RU)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 14/110,487

(22) PCT Filed: Apr. 10, 2012

(86) PCT No.: PCT/EP2012/001555

§ 371 (c)(1),
(2), (4) Date: Oct. 10, 2013

(87) PCT Pub. No.: WO2012/136381

PCT Pub. Date: Oct. 11, 2012

(65) Prior Publication Data

US 2014/0027976 A1 Jan. 30, 2014

(30) Foreign Application Priority Data

Apr. 8, 2011 (RU) ..... 2011113498

(51) Int. Cl.

| | |
|---|---|
| ***B65H 5/00*** | (2006.01) |
| ***B65H 9/10*** | (2006.01) |
| ***B65H 5/06*** | (2006.01) |
| ***B65H 9/00*** | (2006.01) |

(52) U.S. Cl.

CPC ..... *B65H 9/00* (2013.01); *B65H 2404/6942* (2013.01); *B65H 9/106* (2013.01); *B65H 2301/34112* (2013.01); *B65H 2701/1912* (2013.01); *B65H 5/062* (2013.01); *B65H 2557/63* (2013.01); *B65H 2403/725* (2013.01); *B65H 2404/1442* (2013.01)

USPC ..... 271/225; 271/273

(58) Field of Classification Search

CPC ..... B65H 29/125; B65H 2301/34; B65H 2301/341; B65H 2301/3411; B65H 2301/3412; B65H 2404/1421; B65H 2404/143; B65H 2404/1442

USPC ..... 271/225, 273, 274, 184

See application file for complete search history.

(56) References Cited

U.S. PATENT DOCUMENTS

| | | | |
|---|---|---|---|
| 5,413,326 | A | 5/1995 | Wright |
| 6,098,978 | A | 8/2000 | Bielefeld et al. |
| 6,494,451 | B2 | 12/2002 | Michel |

(Continued)

FOREIGN PATENT DOCUMENTS

| | | | |
|---|---|---|---|
| DE | 19632224 | A1 | 2/1998 |
| DE | 10319723 | B3 | 9/2004 |

(Continued)

OTHER PUBLICATIONS

International Search Report from corresponding PCT Application No. PCT/EP2012/001555, Jul. 27, 2012.

*Primary Examiner* — Michael McCullough

(74) *Attorney, Agent, or Firm* — Workman Nydegger

(57) ABSTRACT

The invention relates to a self-adjusting processing system for sheet material. A self-adjusting processing system for sheet material comprises a guiding device for sheet material having a main transport and a redirecting device for sheet material having a branch transport in association with the main transport to redirect the sheet material. The redirecting device further has fixed rollers adopted to interact with the branch transport and floating members, the fixed rollers and the floating members are positioned at opposite sides of the branch transport and each floating member is adopted to be aligned with appropriate fixed roller. The redirecting device further comprises fixing means for fixing the floating members' position relative to the fixed rollers, releasing means for releasing the floating members' position relative to the fixed rollers, and a first actuating means for moving the floating members towards the fixed rollers till the floating members engage the fixed rollers and backwards from the fixed rollers. Also provided is a method of processing of a piece of sheet material with the self-adjusting processing device of the present invention. The processing system and the method can be used with any sheet materials, advantageously with banknotes.

18 Claims, 22 Drawing Sheets

(56) References Cited

U.S. PATENT DOCUMENTS

| | | | |
|---|---|---|---|
| 6,682,068 | B1 | 1/2004 | Haney et al. |
| 7,344,016 | B2 | 3/2008 | Vogel et al. |
| 7,900,914 | B2 | 3/2011 | Fujita et al. |
| 7,900,919 | B2 | 3/2011 | Ledgerwood et al. |
| 8,205,879 | B2 | 6/2012 | Fujita et al. |
| 8,585,049 | B2 | 11/2013 | Fujita et al. |
| 2002/0130463 | A1 | 9/2002 | Michel |
| 2006/0249438 | A1 | 11/2006 | Schwarzbauer et al. |
| 2009/0309299 | A1 | 12/2009 | Ledgerwood et al. |

FOREIGN PATENT DOCUMENTS

| | | | |
|---|---|---|---|
| RU | 2175633 | C1 | 11/2001 |
| RU | 2407693 | C2 | 12/2010 |

SELF-ADJUSTING PROCESSING SYSTEM FOR SHEET MATERIAL AND A PROCESSING METHOD USING SUCH SYSTEM

BACKGROUND OF THE INVENTION

1. Field of the Invention

The invention generally relates to processing systems. In particular, the invention relates to a self-adjusting processing system for sheet material including but not limited to banknotes and the like flat material.

2. Description of Related Art

A processing of sheet material is often used in such devices as dispensers including cash dispensers, classifiers, pickers, etc. In order to prevent skewing of pieces of sheet material in a processing system during processing and transportation position of components in the processing system is adjusted to deliver these pieces of sheet material with required positioning accuracy.

Widely used in the art are processing systems using processing means for sheet material such as belts, rollers and their combinations along with adjusting means for the processing means. However, most of the adjusting means are based on resilient members with delayed adjusting action that leads to deflections of sheet material during its processing. Such adjusting means are not appropriate for adjusting of processing components of a processing system without using additional adjusting means to adjust sheet material position which makes a processing system more complex.

U.S. Pat. No. 7,900,919 discloses a processing system for transportation paper documents between drive rollers and idler rollers which are connected by a pivoting linkage to a center loading spring producing a distributed force to the idler rollers.

However, it is indicated in the document that small deflections are introduced to paper documents during an operation of this system, and it is possible that after some operation time paper documents may be skewed or even jammed while being processed in the system as the result of the summary deflection. Moreover, the center loading spring is used for four idler rollers or more and its force can be distributed not equally for all idler rollers while they are being adjusted which causes extra deflection of paper documents.

Also known from U.S. Pat. No. 6,494,451 is a processing system for processing sheet material with drive rollers and spring biased idler rollers, where the springs of the idler rollers are connected with a pivotal linkage so that the forces of the idler rollers are equalized.

However, this processing system has a relatively large amount of springs having different mechanical properties, which may introduce deflections to sheet material position because of the inertial nature of the pivotal linkage.

Some of mentioned deficiencies were eliminated in a processing device for redirecting rectangular sheet material known from DE 196 32 224 which provides a processing device in which sheet material is redirected from a first transport to a second transport using a draw off device. However, the draw off device can produce skewing of sheet material because it consists of a number of draw off wheels controlled by a common actuator through levers with pivots which should be accurately positioned against the support rollers. Positioning accuracy depends strongly on the quality of original assembly and adjusting, on the skills of a service technician and on wear during operation.

SUMMARY OF THE INVENTION

It is an object of this invention to provide a self-adjusting processing system for sheet material which does not cause any noticeable deflections into the movement of sheet material during its processing and does not have additional control elements.

Accordingly, a self-adjusting processing system for sheet material is provided which comprises a guiding device for sheet material having a main transport and a redirecting device for sheet material having a branch transport in association with the main transport to redirect the sheet material. The redirecting device further has fixed rollers adopted to interact with the branch transport and floating members, the fixed rollers and the floating members are positioned at opposite sides of the branch transport and each floating member is adopted to be aligned with appropriate fixed roller. The redirecting device further comprises fixing means for fixing the floating members' position relative to the fixed rollers, releasing means for releasing the floating members' position relative to the fixed rollers, and a first actuating means for moving the floating members towards the fixed rollers till the floating members engage the fixed rollers and backwards from the fixed rollers.

Such processing system has processing means configured to, without limitation, transport and redirect sheet material and adjusting means providing self-adjusting function for the processing means so that the processing means can be adjusted with high accuracy. Moreover, the processing system does not need any additional means for manually adjusting the processing means.

According to an embodiment of the invention the fixing means comprises a friction brake adopted to interact with a spring, the releasing means comprises a striker and a pusher and the first actuating means comprises a first actuator. The friction brake and the spring of the fixing means maintain the position of the processing means, specifically the floating members, between self-adjusting stages performed by the releasing means and the first actuating means of the redirecting device.

According to another embodiment of the invention the fixing means comprises a friction brake adopted to interact with a spring, the first actuating means comprises a first actuator and the releasing means comprises a second actuator. The first actuator and the second actuator can be independently used in self-adjusting of the processing system which reduces energy consumption of the processing system and its wear.

According to another embodiment of the invention the fixing means and the releasing means comprises an electromagnetic friction brake.

Preferably the floating members comprise floating rollers. Alternatively, the floating members can comprise floating pads.

According to a supplementary embodiment the guiding device further comprises at least two guiding rollers connected to the first actuating means, the first actuating means being adopted to move the guiding rollers towards the main transport till the engagement with the main transport and backwards from the main transport, stabilization means configured to stabilize the relative positions of the guiding rollers when they are being moved away from the main transport, and at least two support rollers, wherein the guiding rollers and the support rollers are positioned at opposite sides of the main transport.

Stabilization means provides the accurate appropriate position for the guiding rollers of the guiding device when sheet material is redirected from the guiding device to the redirecting device such that no deflections are introduced into the movement of the sheet material during its processing.

Preferably the stabilization means comprises at least two first suspensions each connecting two adjacent guiding rollers and at least one second suspension connected to the first suspensions substantially directly or at the proximity of common mass centers of every first suspension and their corresponding guiding rollers, the first suspensions and the second suspension having rotational joints substantially at their mass centers, wherein the first actuating means are connected to the guiding rollers directly or at the proximity of a common mass center of the second suspension and the first suspensions with their corresponding guiding rollers. Connecting the suspensions to other components of the processing device at the proximity of their common mass centers helps to compensate forces that can arise in such construction of the processing device and that can be responsible for unnecessary deflections.

Also provided is a method of processing of a piece of sheet material with the self-adjusting processing device comprising: locating a piece of sheet material on the moving main transport of the guiding device to transport the sheet material to the branch transport of the redirecting device; clamping the piece of sheet material between the guiding rollers and support rollers; moving the guiding rollers away from the piece of sheet material using the first actuating means and stabilization means and clamping the piece of sheet material between the floating members and the fixed rollers using the first actuating means to transport the piece of sheet material to the branch transport of the redirecting device; releasing the floating members' position using the releasing means; fixing the floating members' position using the fixing means after the floating members are realigned fully or at least partially in an accumulative way with the fixed rollers; moving the floating members away from the fixed rollers using the first actuating means; and engaging the guiding rollers with the main transport to align the guiding rollers with the support rollers.

According to another method before locating a piece of sheet material on the moving main transport of the guiding device to transport the sheet material to the branch transport of the redirecting device the method further comprises engaging the floating members with the fixed rollers, releasing the floating members' position to fully align the floating members with the fixed rollers and fixing the floating members' position using the fixing means; said releasing and fixing actions not performed when processing the piece of sheet material.

This method provides self-adjusting, for example and without limitation, only before the beginning of the performance of the processing device which can be favorable for some operating modes of the processing device. Nevertheless, such method meets accuracy requirements for the position of sheet material during its processing.

Further aspects and features of the present invention can be appreciated from the appended drawings and the written description.

DETAILED DESCRIPTION OF THE PREFERRED EMBODIMENTS

A processing system for sheet material according to one of the embodiments may be used for processing sheet material which may include its transportation, analyzing, redirecting, sorting and/or other kinds of processing based on plurality of parameters using a guiding device and at least one redirecting device. All operations of the processing must be performed without introducing any deflections of sheet material that is achieved by self-adjustment of the system's units.

Figure 1:
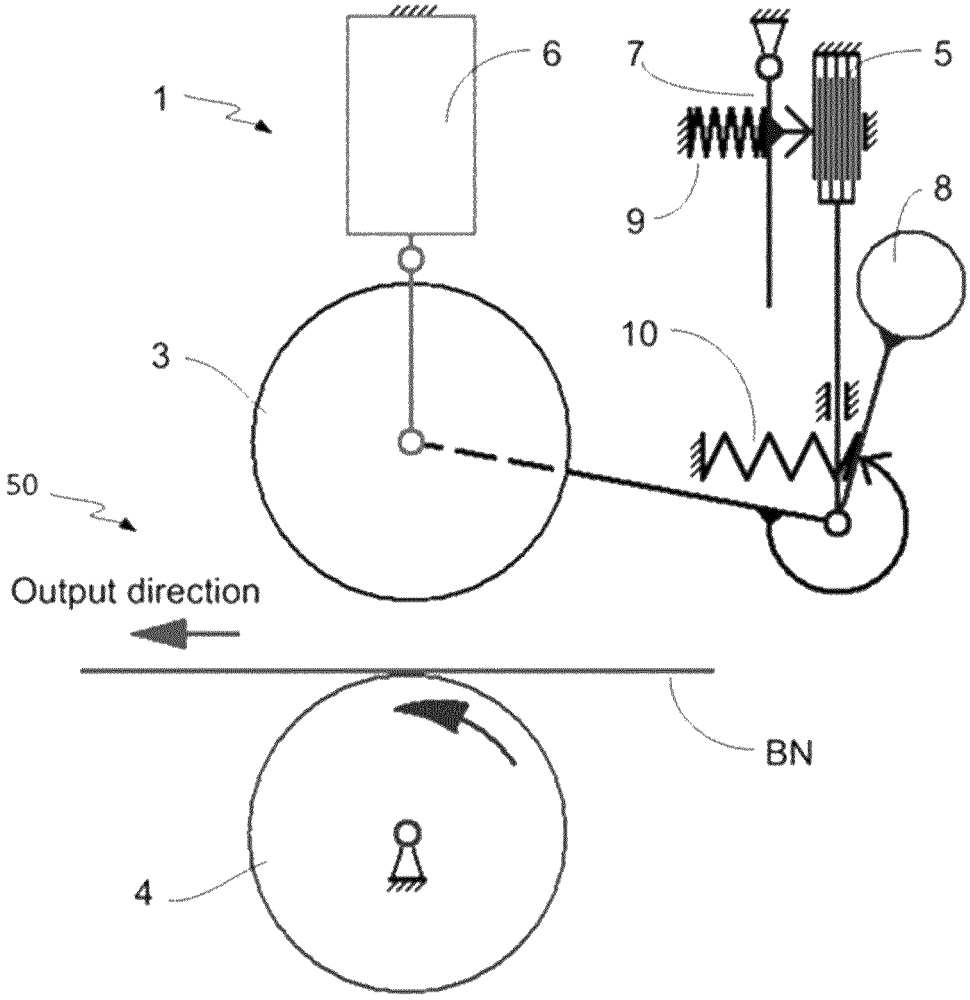
FIG. 1 is a schematic front view of a redirecting device of a processing system for sheet material with passive self-adjustment according to one of the embodiments.
Figure 2:
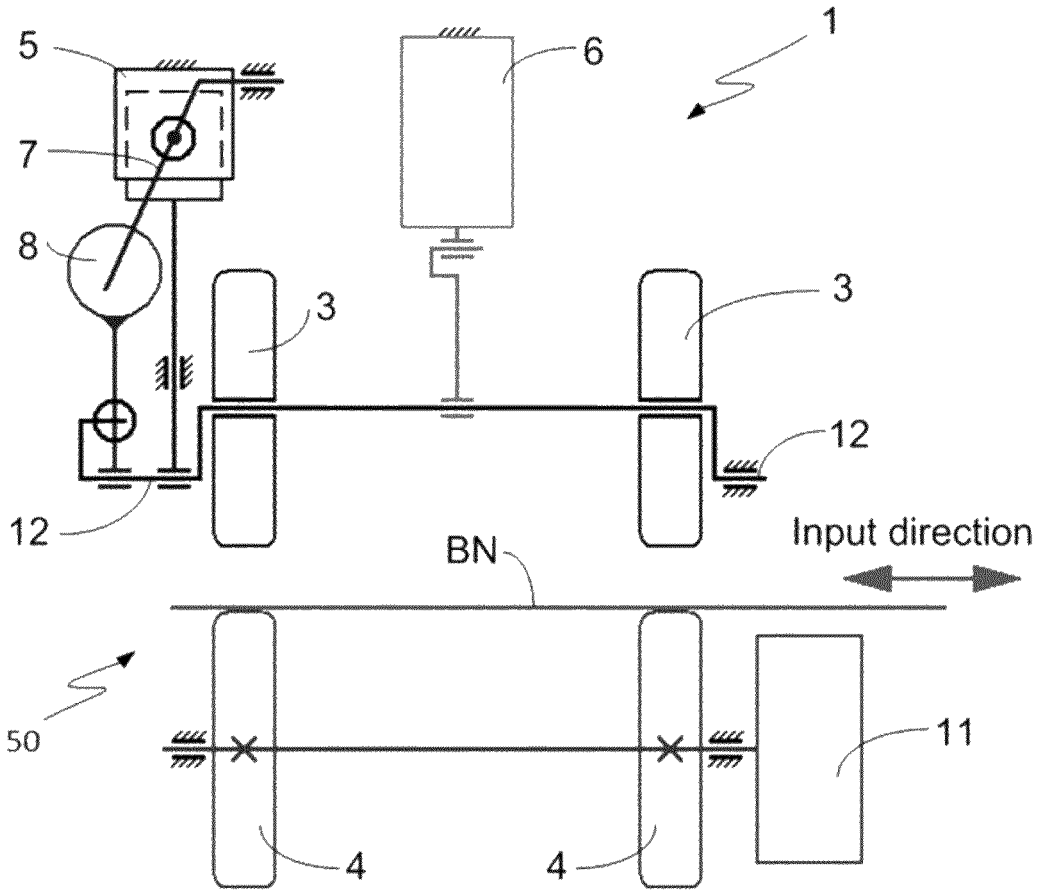
FIG. 2 is a schematic side view of the redirecting device of FIG. 1.
Figure 3:
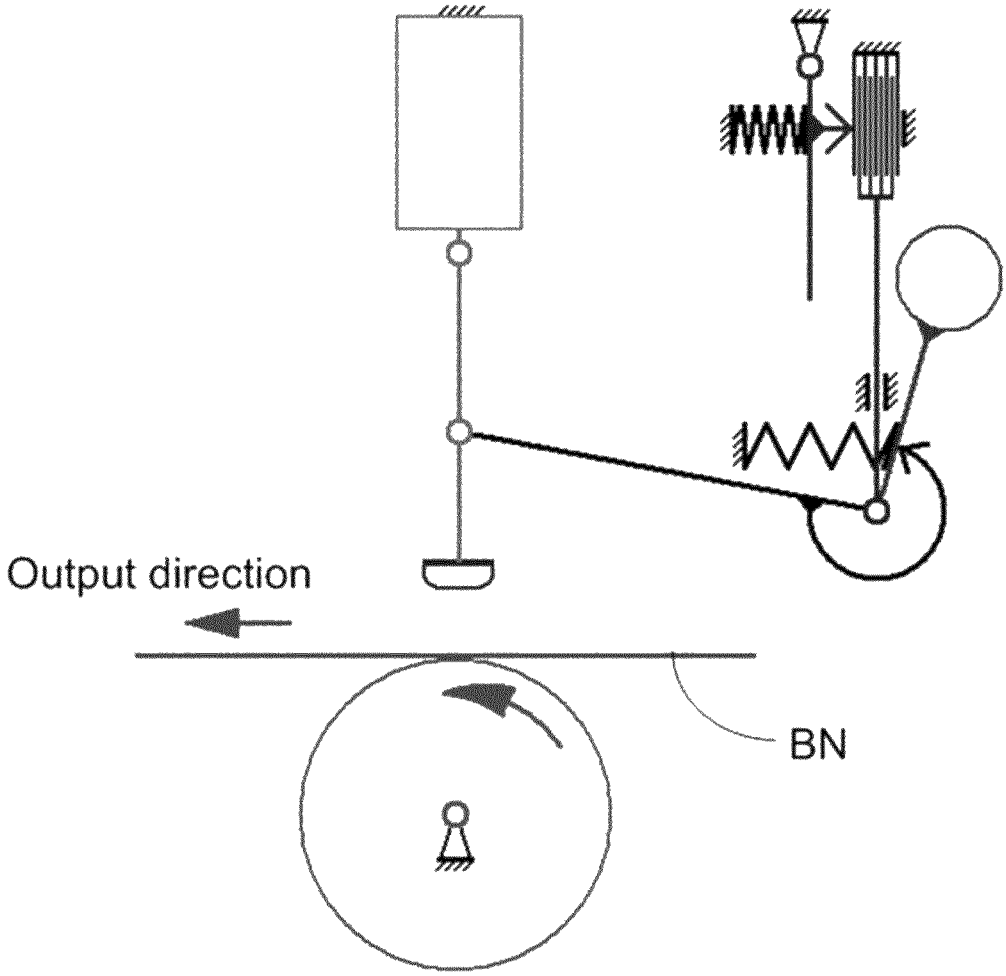
FIG. 3 is a schematic front view of the redirecting device of FIG. 1 with another type of floating members.

FIGS. 1 and 2 schematically show a redirecting device 1 of a processing system for sheet material with passive self-adjustment according to one of the embodiments. According to this embodiment a branch transport (partially shown) is used to redirect pieces of sheet material, for example but without limitation banknotes BN, from a main transport of the guiding device (not shown) with floating members 3 and fixed rollers 4 driven by a drive 11 and configured to interact with the branch transport 50. In some embodiments the fixed rollers 4 can also be a part of the branch transport 50. Floating members and fixed rollers are positioned at opposite sides of the branch transport such that each floating member may be aligned with appropriate fixed roller. In this embodiment floating members 3 have the form of floating rollers 3, however in other embodiments they can represent floating pads (see FIG. 3) made of antifriction and/or antistatic material that can also have a special coating. Returning to FIG. 1 the redirecting device also comprises a friction brake 5 interacting with a spring 9 and configured to fix the position of floating rollers 3, connected to a pusher 7 that can be affected by a striker 8 and change the interaction force between the friction brake 5 and the spring 9. The striker 8 is mounted in a follower in a way to interact with a spring 10 and it is connected with the floating rollers 3 by a crank connecting link. The position of the floating rollers 3 relative to the rollers can be changed by first actuating means, for example, an actuator 6 that is configured to apply equal or substantially equal force to each floating roller 3. Components of the processing system are controlled by a control device (not shown).

Figure 4A:
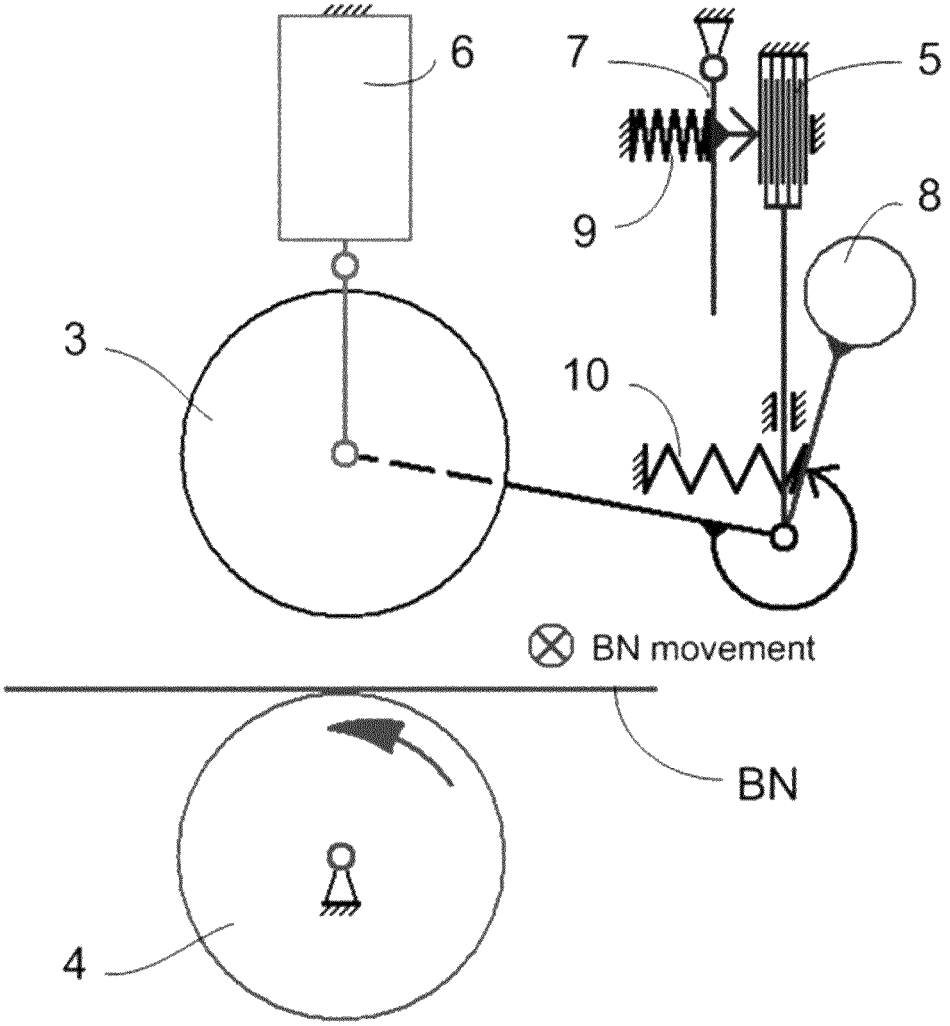
FIGS. 4A-4C, 5A-5D illustrate operation of fixing and releasing means of the redirecting device of FIG. 1 during the processing of a sheet material.
Figure 4B:
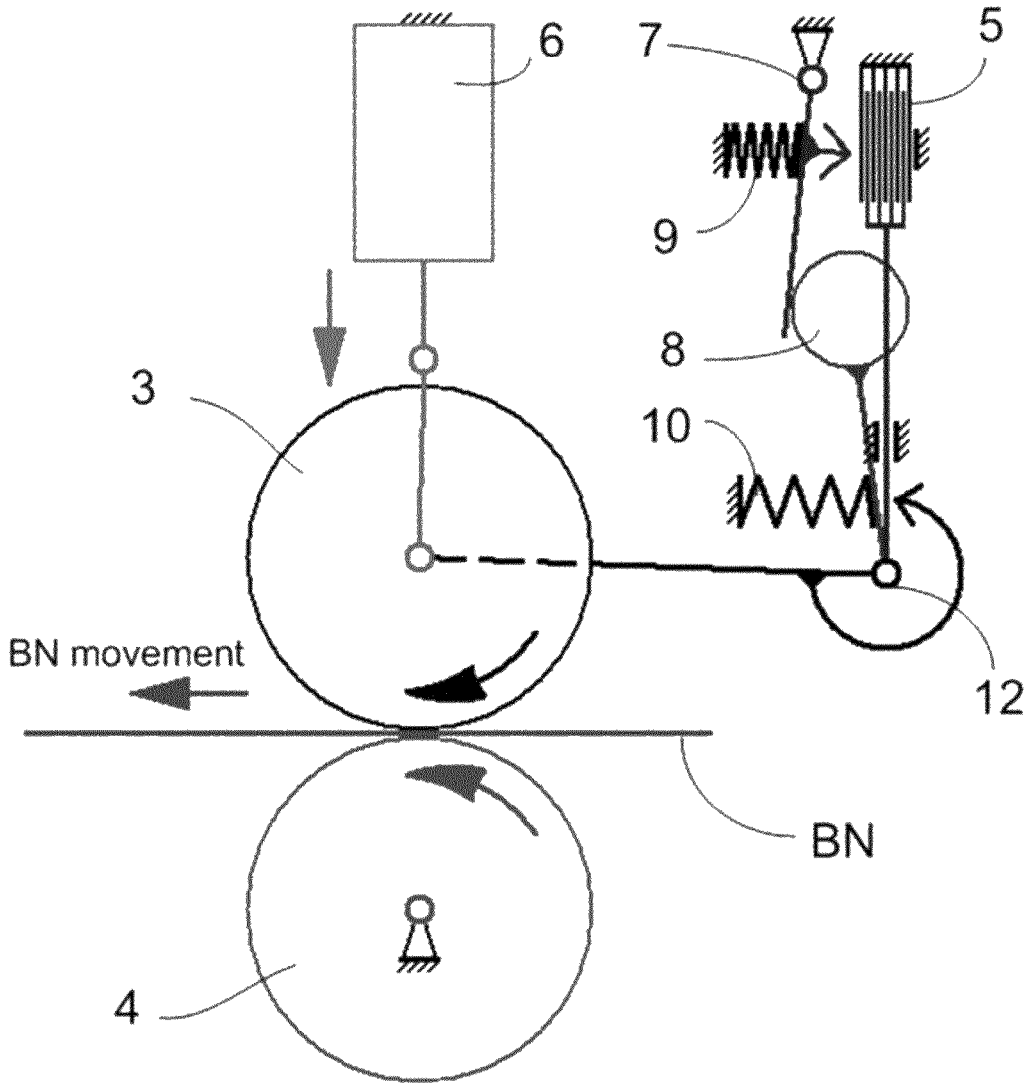
Figure 4C:
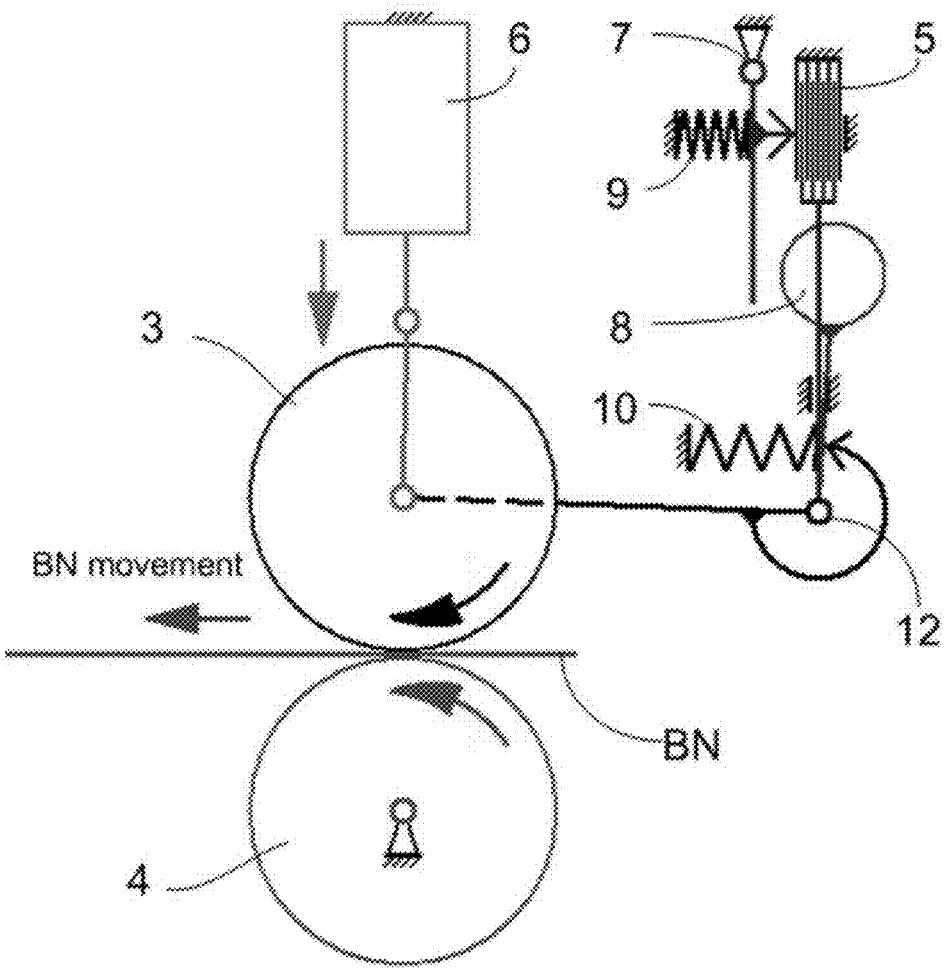
Figure 5A:
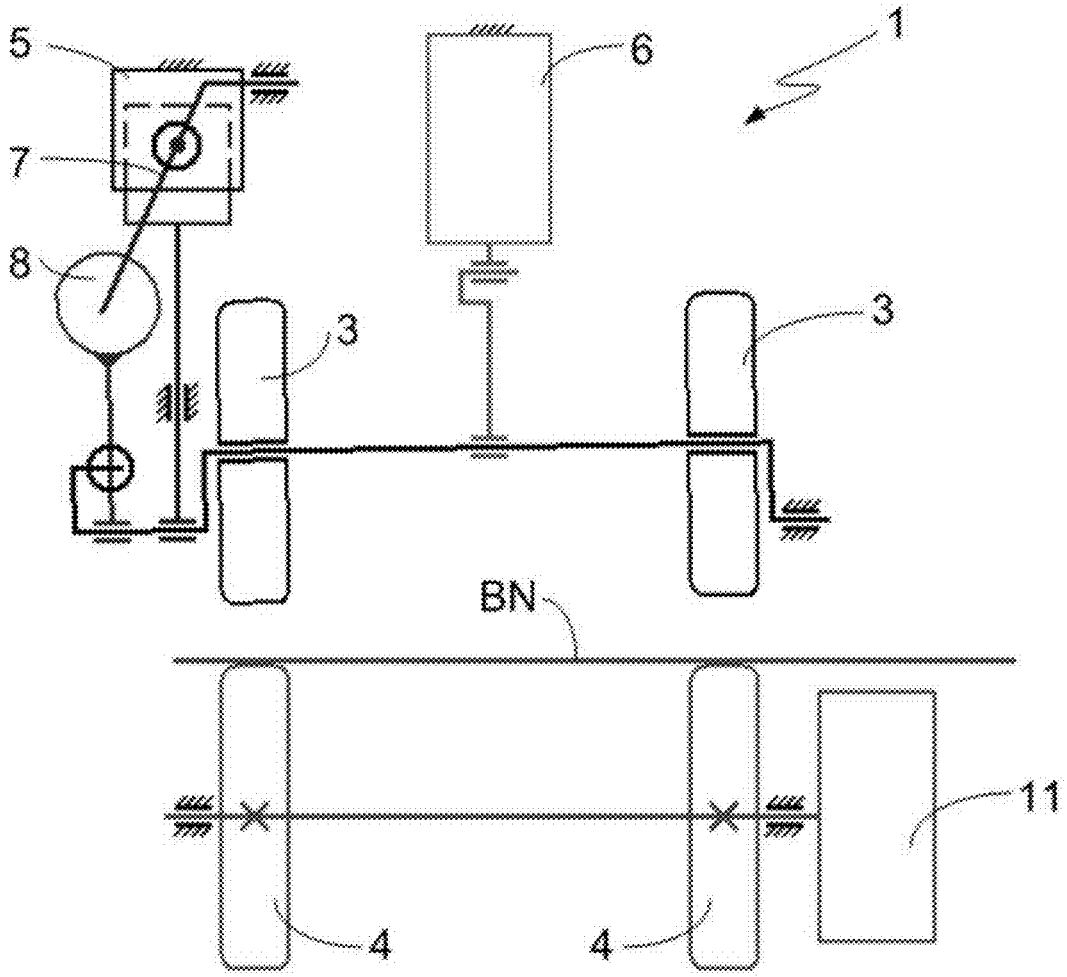
Figure 5B:
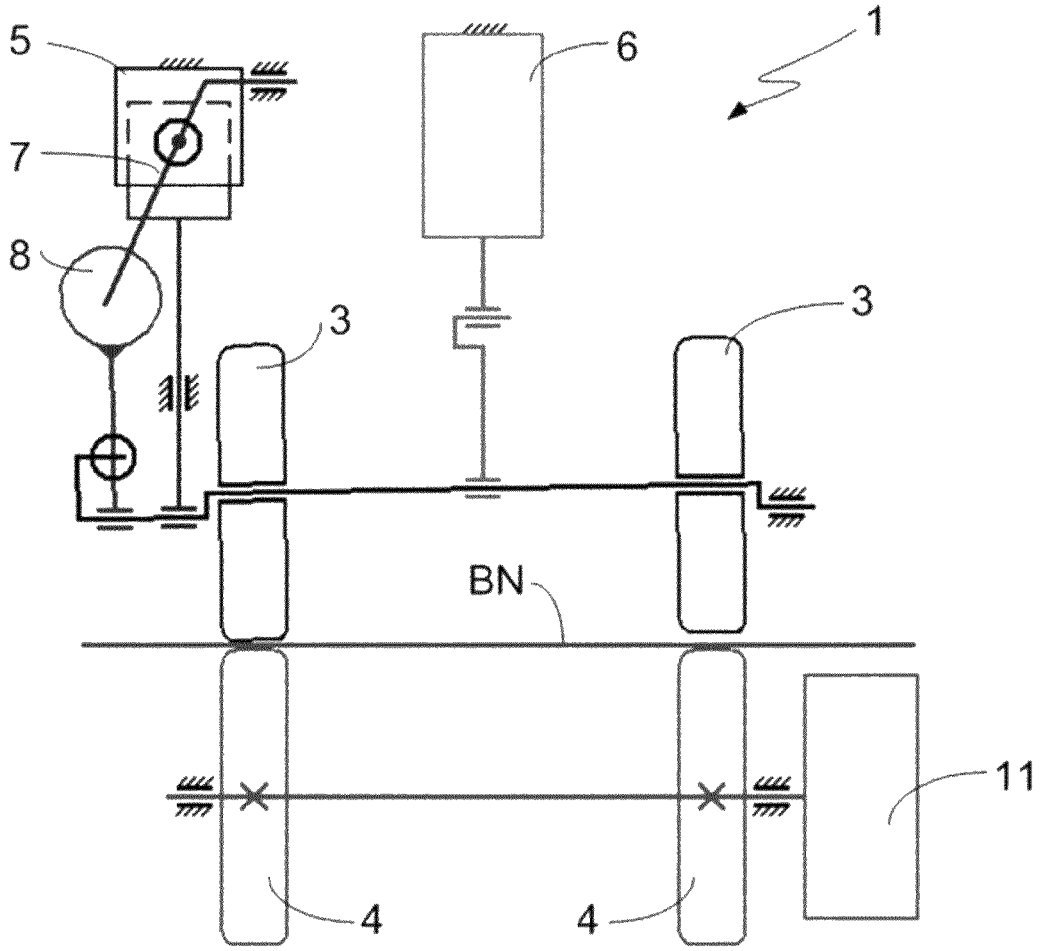
Figure 5C:
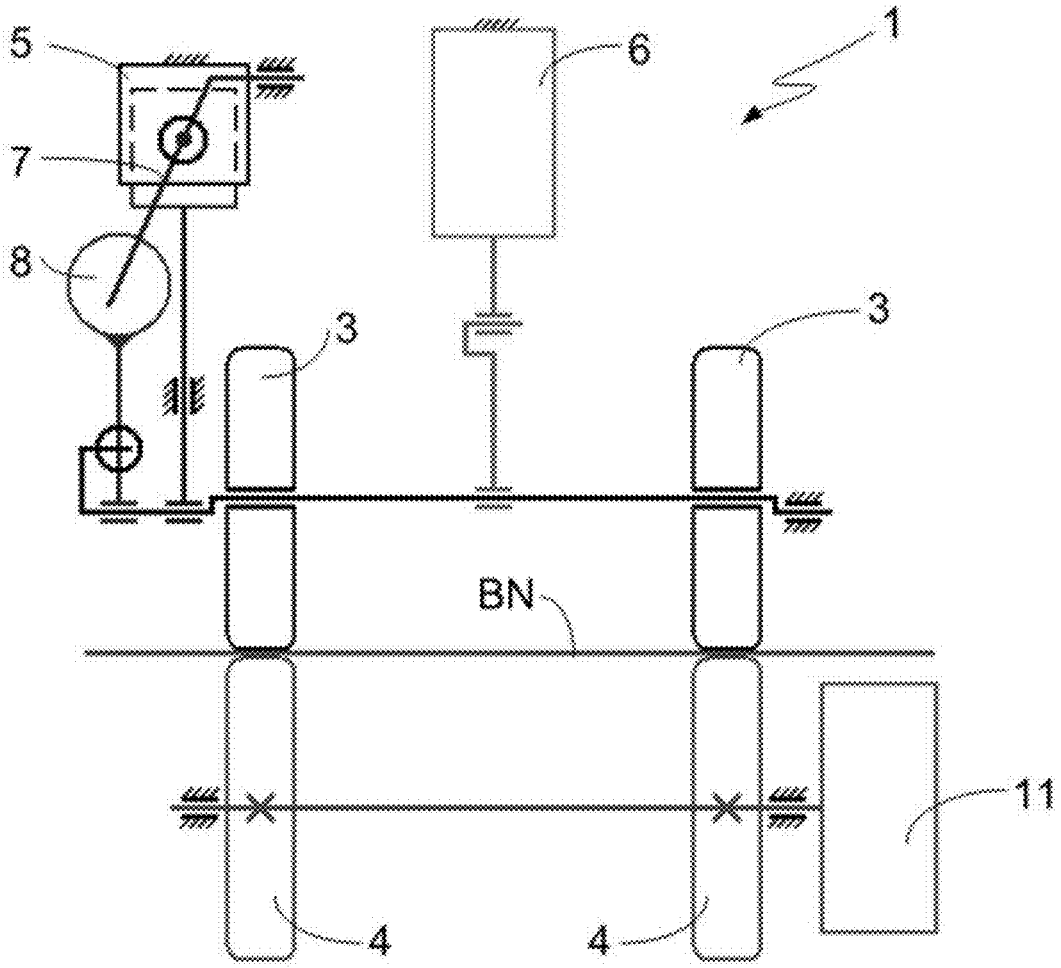
Figure 5D:
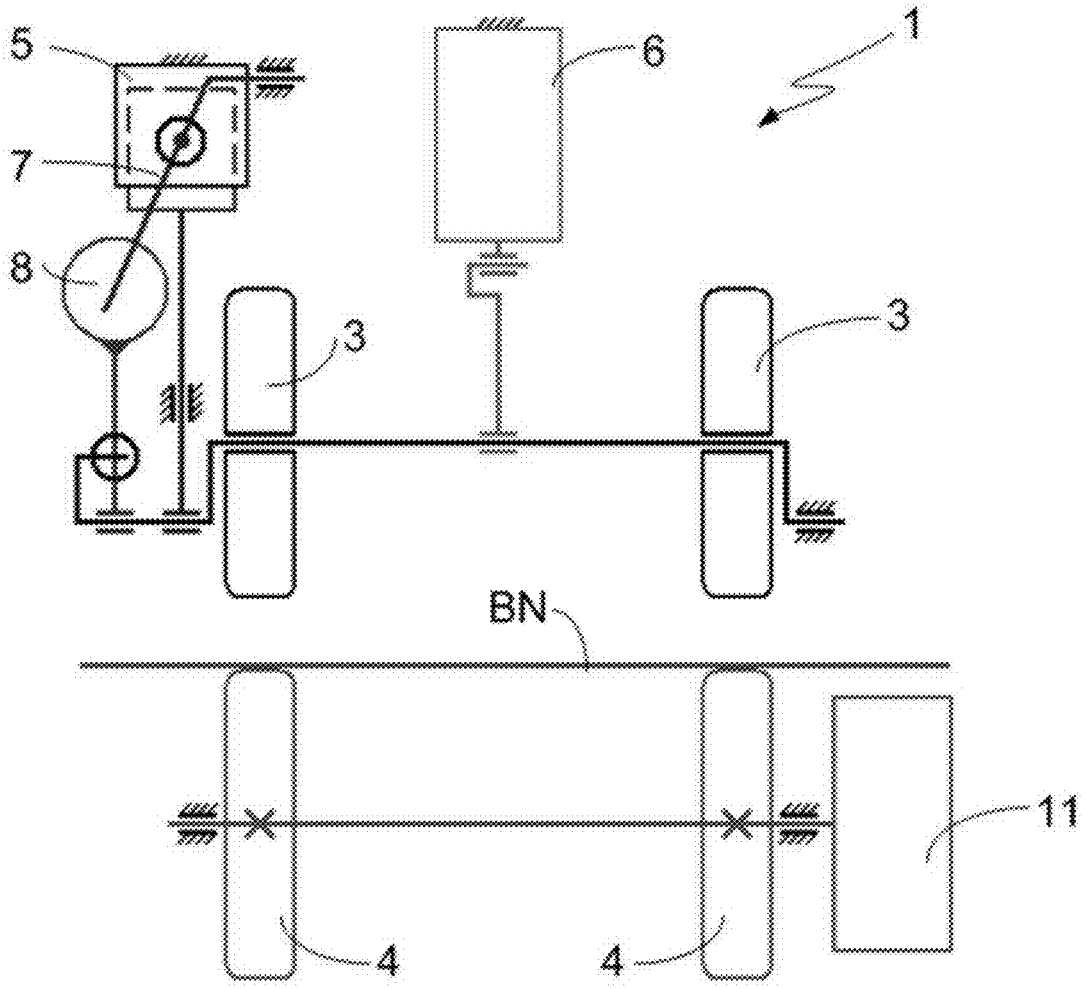

Before a banknote is redirected to the branch transport by the redirecting device 1 position of the floating rollers 3 is fixed by a friction brake and the floating rollers 3 are drawn aside from the fixed rollers 4, as it is shown on FIG. 4A. FIG. 5A illustrates this stage when the redirecting device 1 is unbalanced that appears as different separations between floating rollers 3 and fixed rollers 4. When the banknote enters redirecting device 1 the actuator 6 moves the rollers 3 till they clamp with the rollers 4 (FIG. 4B). When the redirecting device 1 is unbalanced one of the floating rollers interacts with a banknote BN earlier than another floating roller (FIG. 5B). At that moment the striker 8 moves by inertia and interacts with the pusher 7 that minimizes the interaction force between the spring 9 and the friction brake 5 and releases the axis 12 of the rollers 3 from fixing force of the friction brake 5 (FIG. 4B). As soon as the friction brake 5 force is reduced the rollers 3 are realigned with the rollers 4 by the force of the actuator 6 as it is shown in FIG. 5C. Then the striker returns to its initial position by the force of the spring 10 and the friction brake 5 fixes the axis 12 of the rollers 3 which have just been realigned with the rollers 4 (FIG. 4C). Then realigned rollers 3 are drawn aside from the rollers 4 until the next redirecting stage as shown in FIGS. 1 and 5D. In this process rollers 3 were "passively" self-adjusted during redirecting a piece of sheet material without any additional driving and control components.

Figure 6:
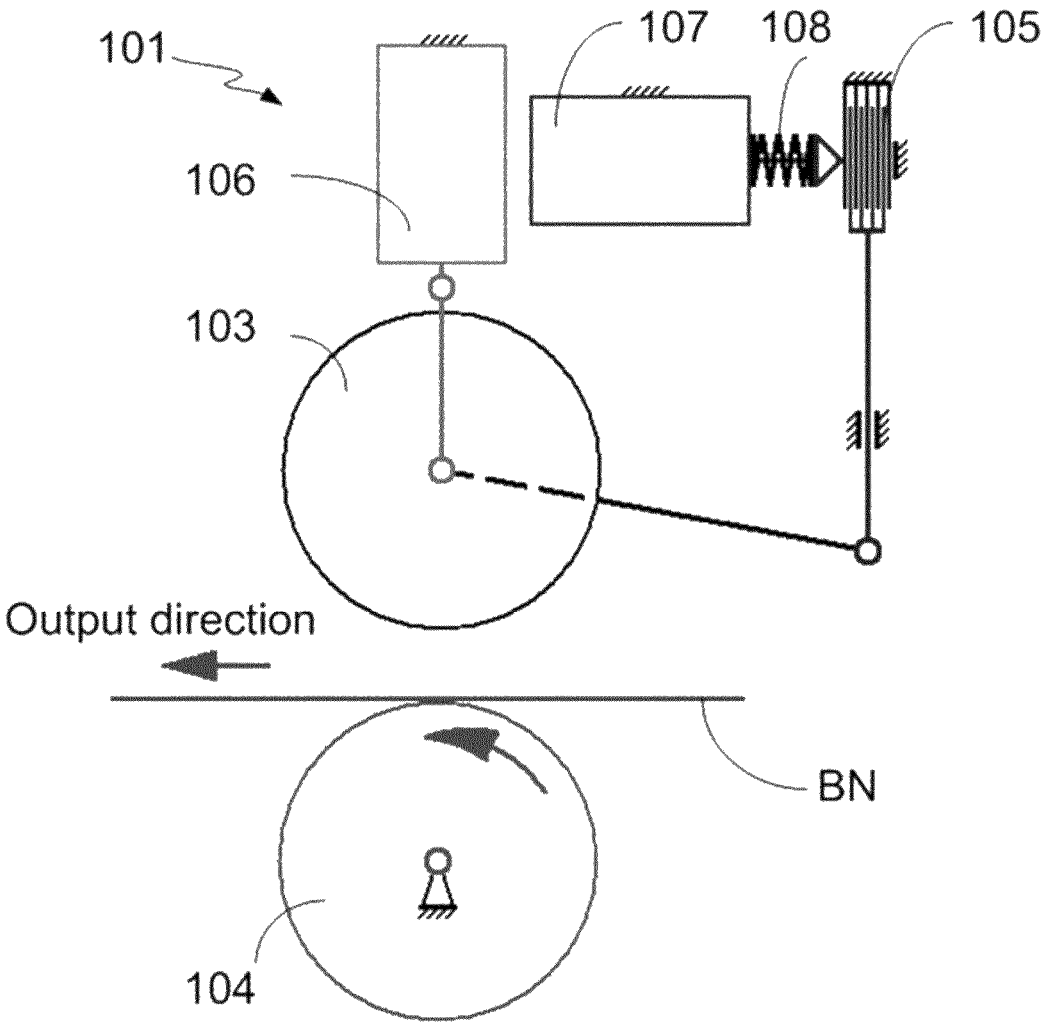
FIG. 6 is a schematic front view of a redirecting device of a processing system for sheet material with active self-adjustment according to another embodiment.
Figure 7:
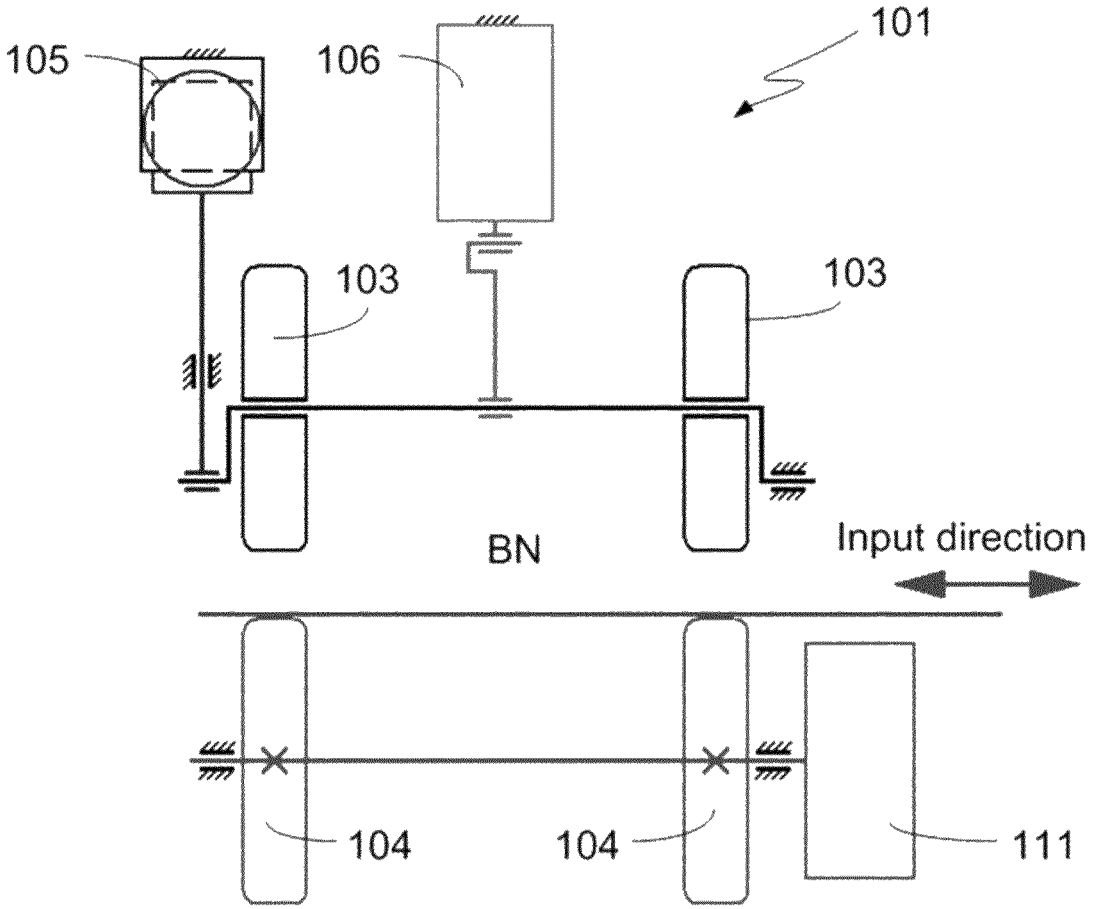
FIG. 7 is a side schematic view of the redirecting device of FIG. 6.

FIGS. 6 and 7 schematically show a redirecting device 101 of a processing system for sheet material with active self-adjustment according to another embodiment.

The redirecting device 101 is analogous to the redirecting device 1 of FIG. 1 and comprises a branch transport 50 (partially shown) with floating rollers 103 and fixed rollers 104 positioned at different sides of the branch transport 50. The rollers 103 can be moved by an actuator 106 and their spatial position is fixed by a friction brake 105 which interacts with a spring 108 controlled by another actuator 107.

Figure 8A:
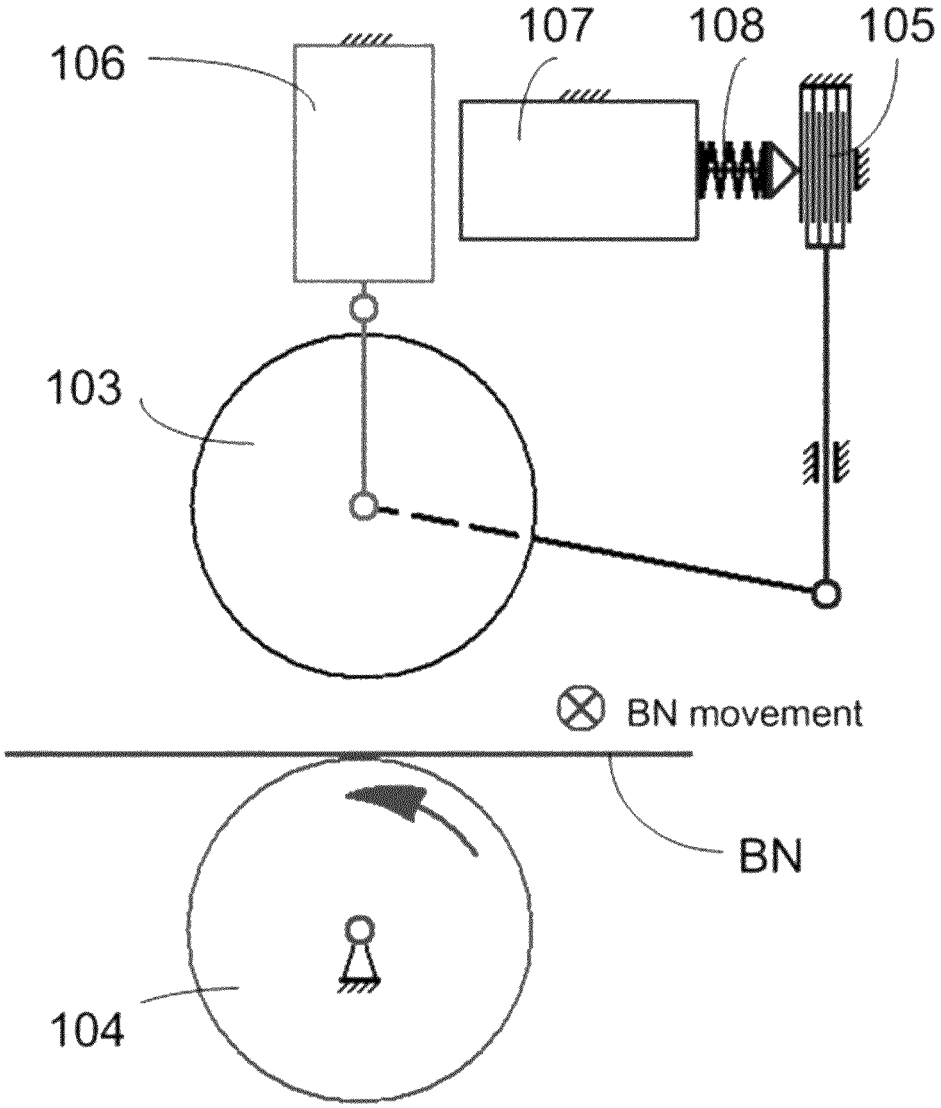
FIGS. 8A-8C illustrate operation of fixing and releasing means of the redirecting device of FIG. 6 during the processing of a sheet material.
Figure 8B:
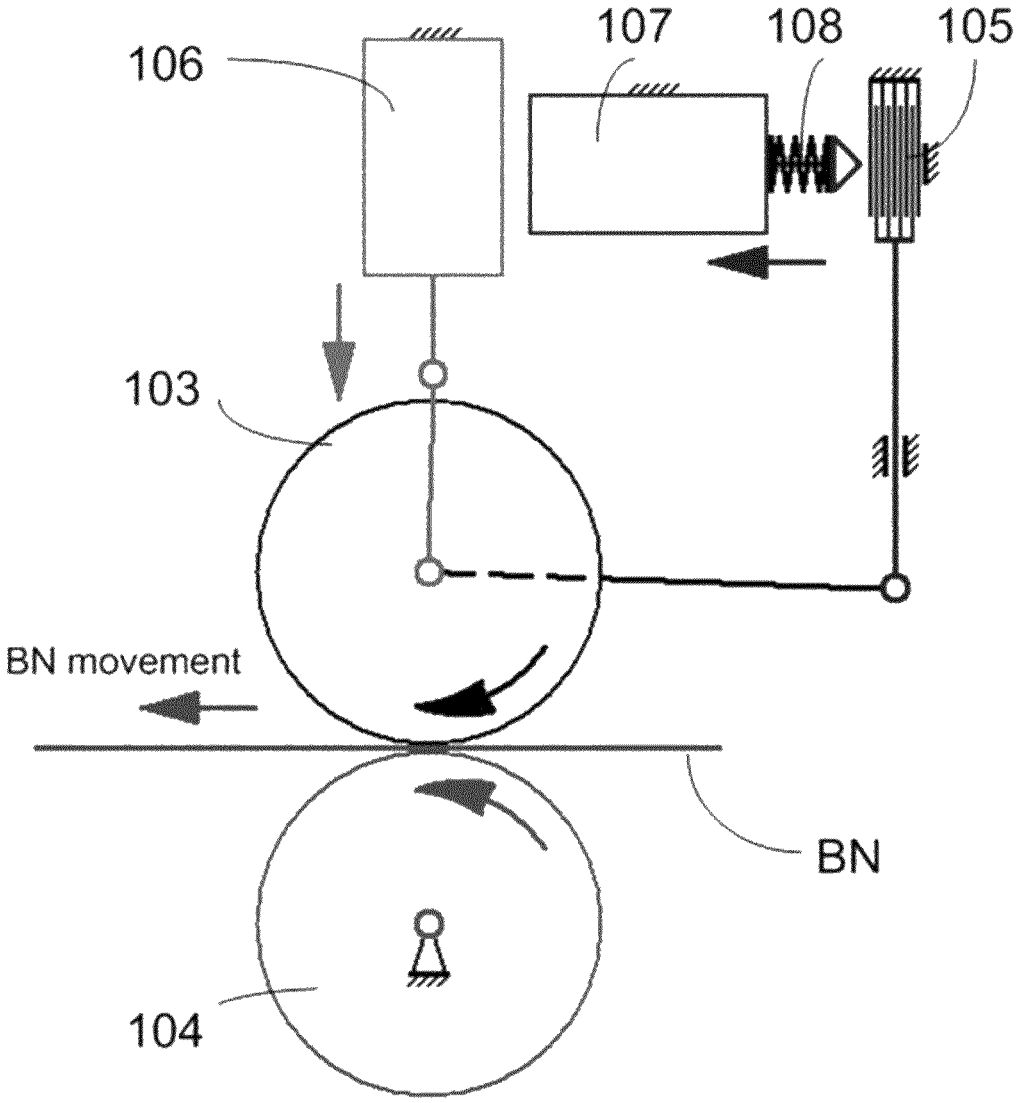
Figure 8C:
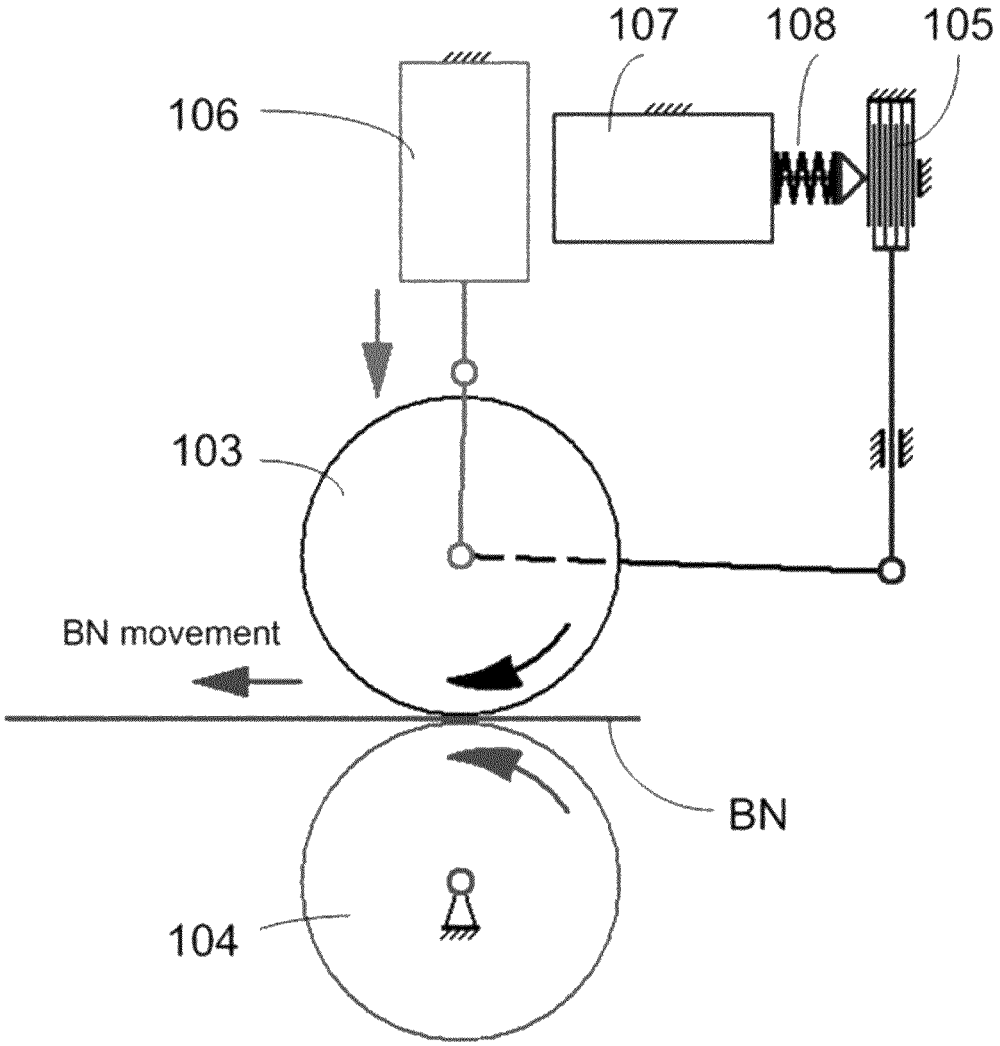

FIG. 8A shows the state of the redirecting device 101 when a piece of sheet material, for example a banknote BN, is in a position in which it needs to be redirected. The rollers 103 that are primarily drawn from the rollers 104 are moved to the rollers 104 by an actuator 106 so as to clamp the banknote (FIG. 8B). Then the spring 108 is removed from the friction brake 105 by the actuator 107 as a response to a control signal (FIG. 8B) and the rollers are realigned with the rollers 104 by the continuing action of the actuator 106. Next, the actuator 107 is de-energized by removing its control signal and the spring 108 pushes the friction brake 105 (FIG. 8C). The rollers 103 become fixed in their realigned position by the friction brake 105 and are moved from the rollers 104 by the actuator 106 to the position shown in FIG. 8A.

In this embodiment fewer elements are moved by the first actuator during self-adjustment. Moreover, it is possible to perform such self-adjustment "actively" not in every redirecting event and/or without sheet material including when one or both transports are not running, for example, once before the processing of sheet material.

Figure 9:
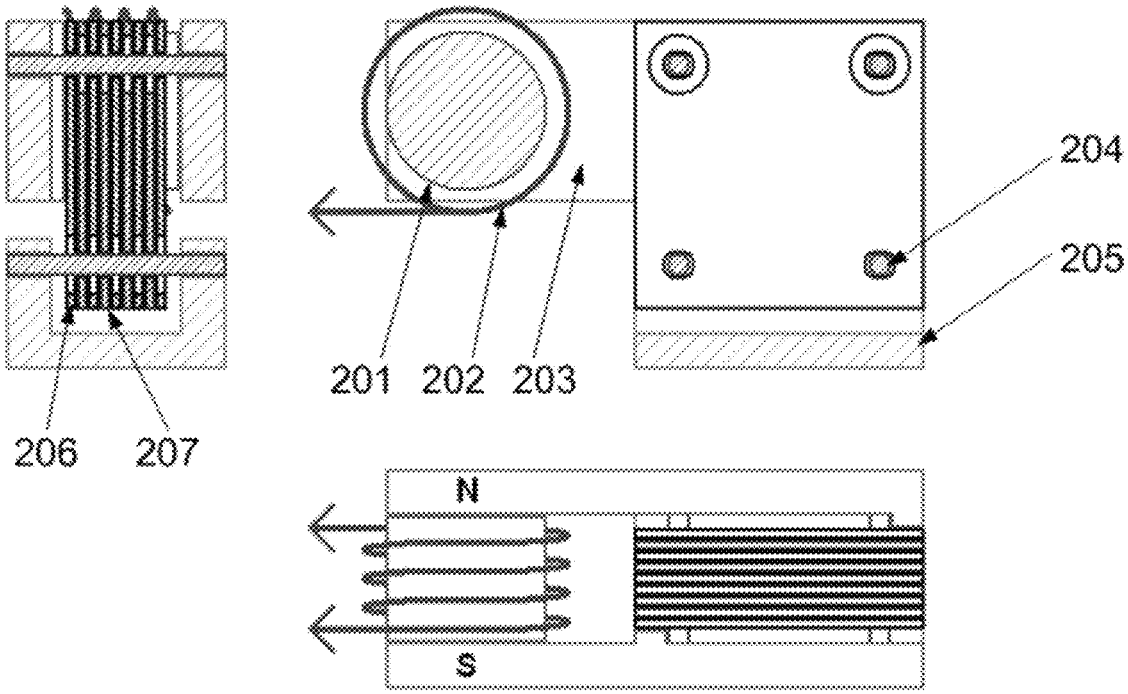
FIG. 9 schematically shows views of an integrated electromagnetic friction brake according to one of the embodiments.

FIG. 9 illustrates an integrated electromagnetic friction brake that can be used to replace the actuator 107, the spring 108 and the friction brake 105 according to some embodiments. This electromagnetic friction brake comprises a permanent magnetic core 201, a coil 202, and magnetic conductors 203. Further, it has anchor magnetic friction plates 206 and movable magnetic friction plates 207 mounted with pins 204 that are configured to provide the movement of the movable bracket 205.

Figure 10:
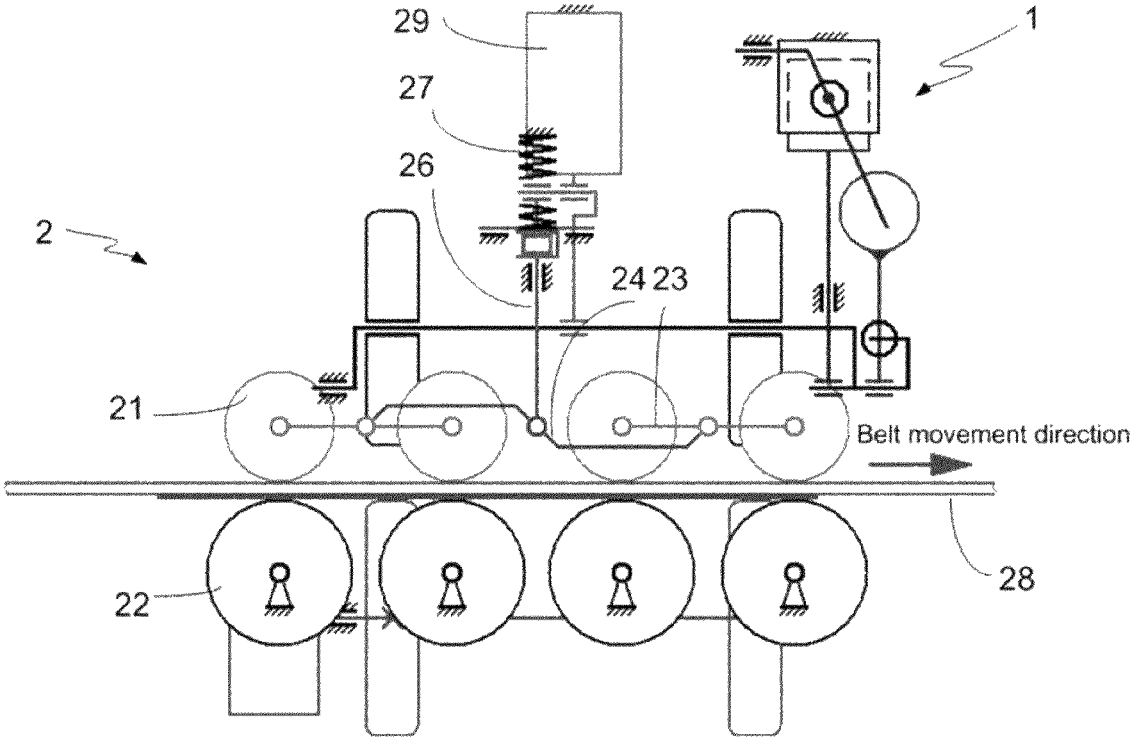
FIG. 10 is a schematic side view illustrating the first action phase of guiding rollers of a processing system for sheet material according to one of the embodiments.
Figure 11:
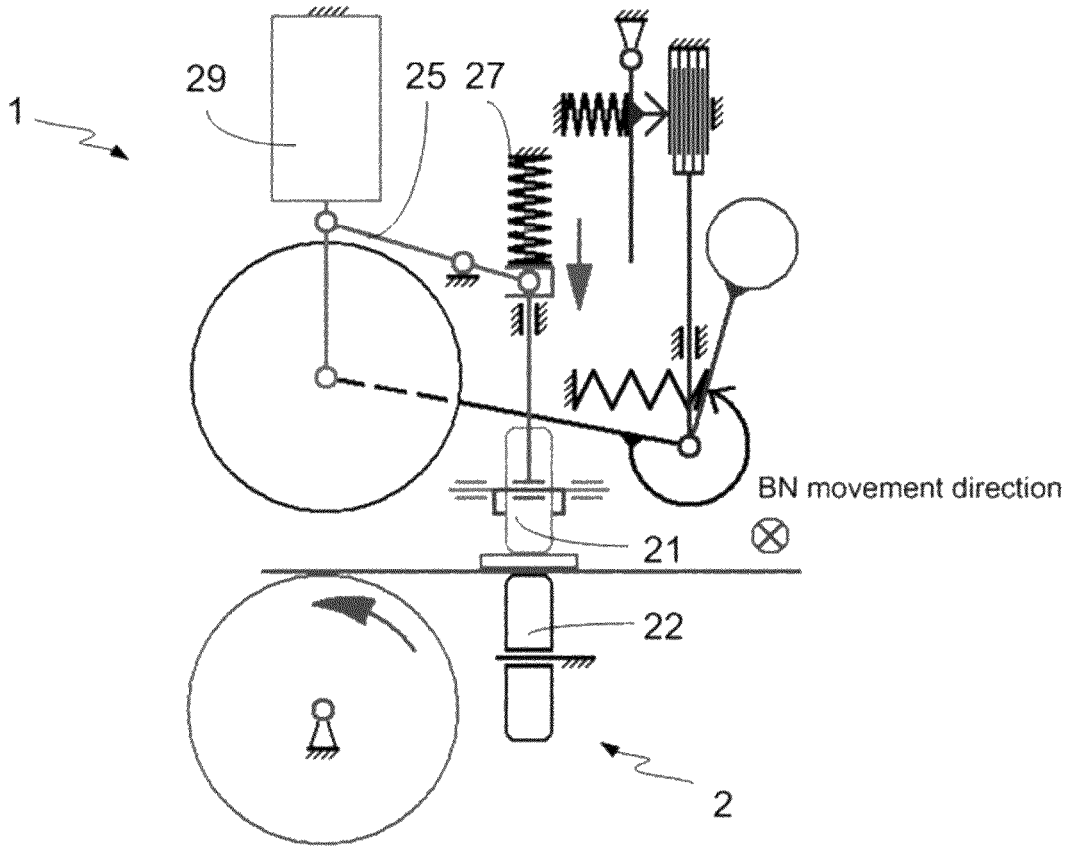
FIG. 11 is a schematic front view illustrating the first action phase of the guiding rollers of FIG. 10.

FIGS. 10 and 11 illustrate the first action phase of guiding rollers of a guiding device 2 of a processing system according to one of the embodiments with shown redirecting device 1 of FIG. 2. According to this embodiment the guiding device 2 and the redirecting device 1 are arranged perpendicularly to each other, but they can have other relative positions.

The guiding device 2 can be used with any possible configuration of the redirecting device according to present invention. The guiding device 2 comprises a main transport, in this embodiment a driving belt 28, at least two guiding rollers 21 interconnected with stabilization means and connected with a guide 26 and a transmission 25 to the first actuating means (comprised of an actuator 29 and a spring 27) and at least two support rollers 22, the rollers 21 and 22 are positioned at different sides of the driving belt 28, correspondingly. As it is shown in FIGS. 10 and 11 the guiding rollers 21 are pressed by the spring 27 substantially equally to the belt 28.

In this embodiment the stabilization means provide simultaneous lifting of the rollers 21 by the actuating means and comprises two first suspensions 23 connecting adjacent two rollers 21 and a second suspension 24 connected to the first suspensions 23 substantially at common mass centers of every first suspension 23 and their corresponding rollers 21. Rotational joints of the suspensions 23 and 24 are located as close as possible to their respective mass centers which provides simultaneous movement of the rollers 21. It shall be noted that the second suspension 24 can be connected to the first suspensions 23 substantially at the proximity of their common mass centers with corresponding rollers 21 to compensate yaw moments, turning moments and other undesirable forces. The first actuating means are connected to the rollers 21 directly or at the proximity of a common mass center of the second suspension 24 and the first suspensions 23 with their corresponding rollers 21.

In one of the embodiments rotational joint of the suspensions 23 and 24 are moved with some friction that can be either constant, or dependent on the rotation rate of the joints, the latter can be provided by applying a viscous fluid. Such frictionally moved joints can reduce the vertical displacement of the guiding rollers 21 after they are moved away from the main transport of the guiding device 2.

Also in this embodiment, the number of rollers 21 and 22 may depend on the sheet material type and size variance and can be different than four shown in FIG. 10. For example, each suspension 23 with two rollers 21 can be replaced with a single roller 21 and only two rollers 22 left re-positioned to be aligned with rollers 21 which will constitute a processing device with a minimum number of guiding and support rollers.

In some embodiments the first actuating means comprises an actuator along with a spring for the redirecting device and another actuator along with another spring for the guiding device. When banknotes are redirected these actuators move the guiding rollers and the floating members independently in different directions.

Before processing sheet material the guiding device of the processing system can be realigned by engaging the floating rollers with the fixed rollers, releasing the friction brake until the floating members are fully aligned with fixed rollers and fixing the friction brake to keep the floating members in aligned position. Then the guiding device 2 transports sheet material to the redirecting device 1 which branch transport is associated with the main transport of the guiding device 1. Pieces of sheet material can also be processed by transporting them using the main transport without redirecting utilizing the redirecting device.

Figure 12:
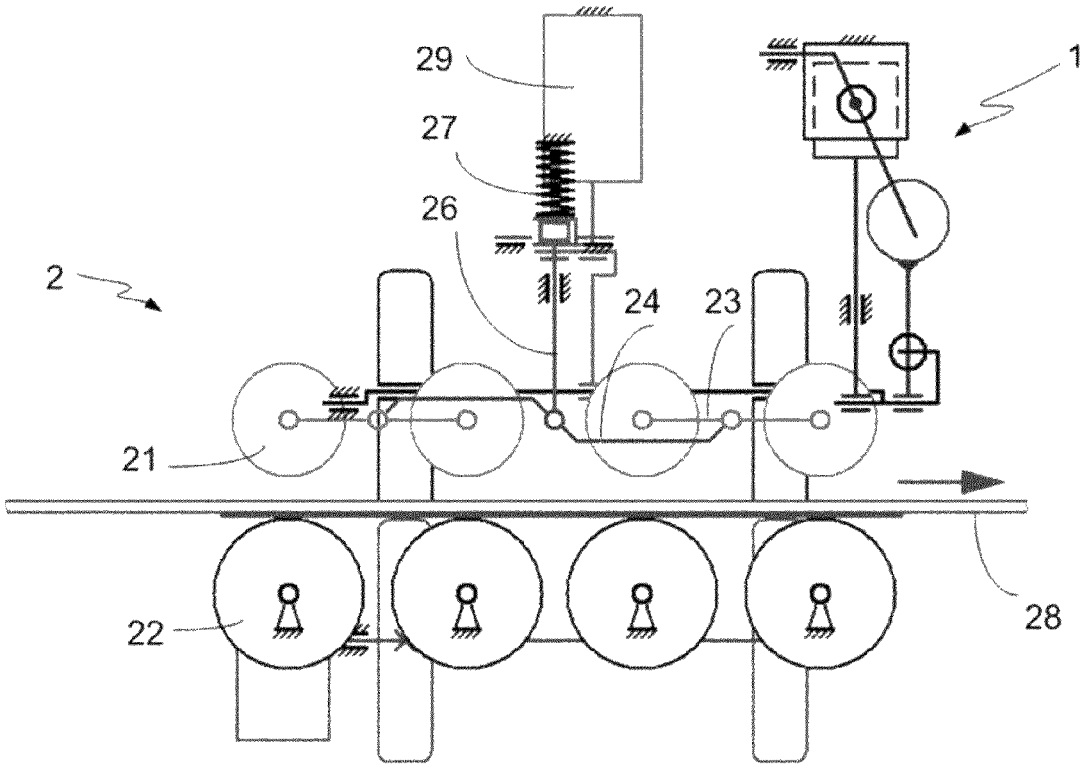
FIG. 12 is a schematic side view illustrating the second action phase of the guiding rollers of FIG. 10.
Figure 13:
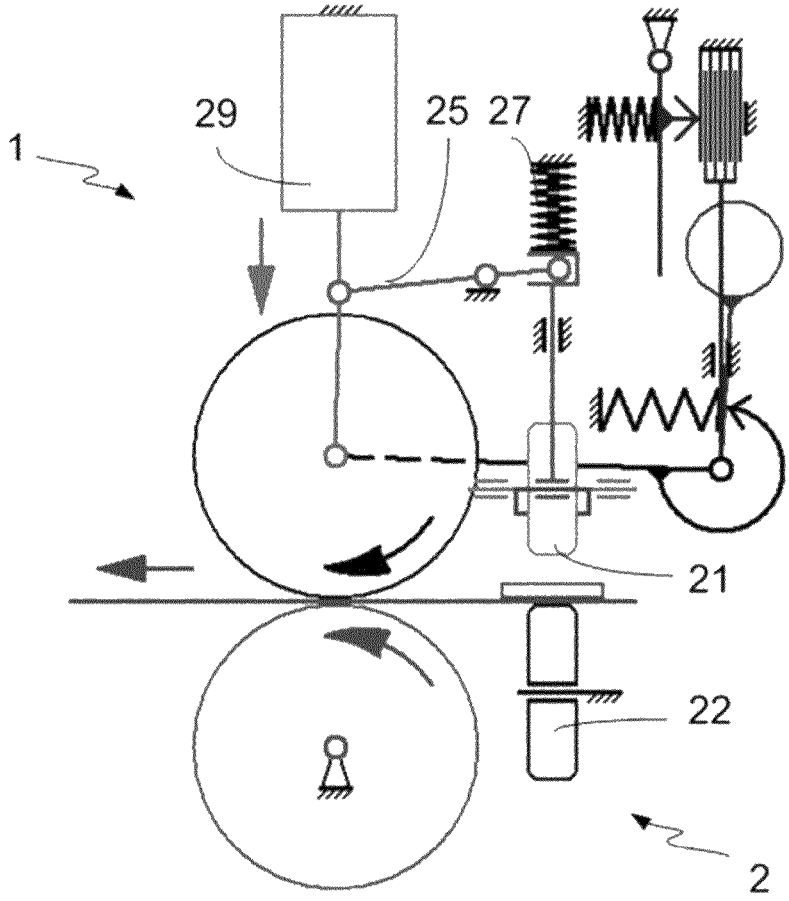
FIG. 13 is a schematic front view illustrating the second action phase of the guiding rollers of FIG. 10.
Figure 14:
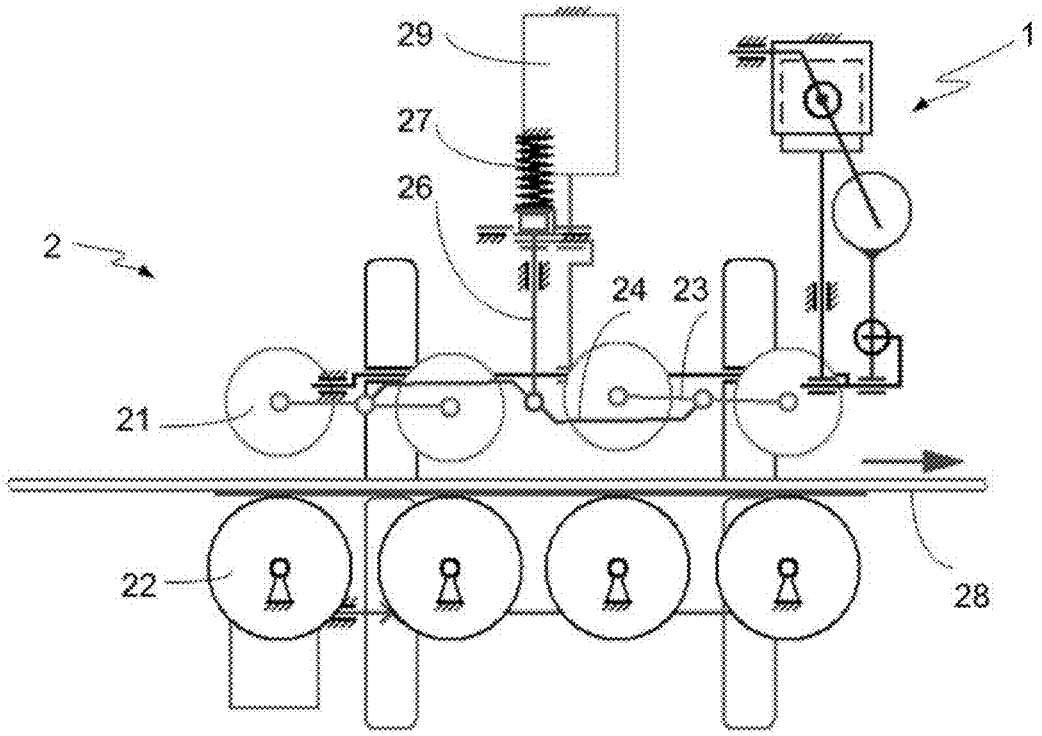
FIG. 14 is a schematic side view illustrating the third action phase of the guiding rollers of FIG. 10.
Figure 15:
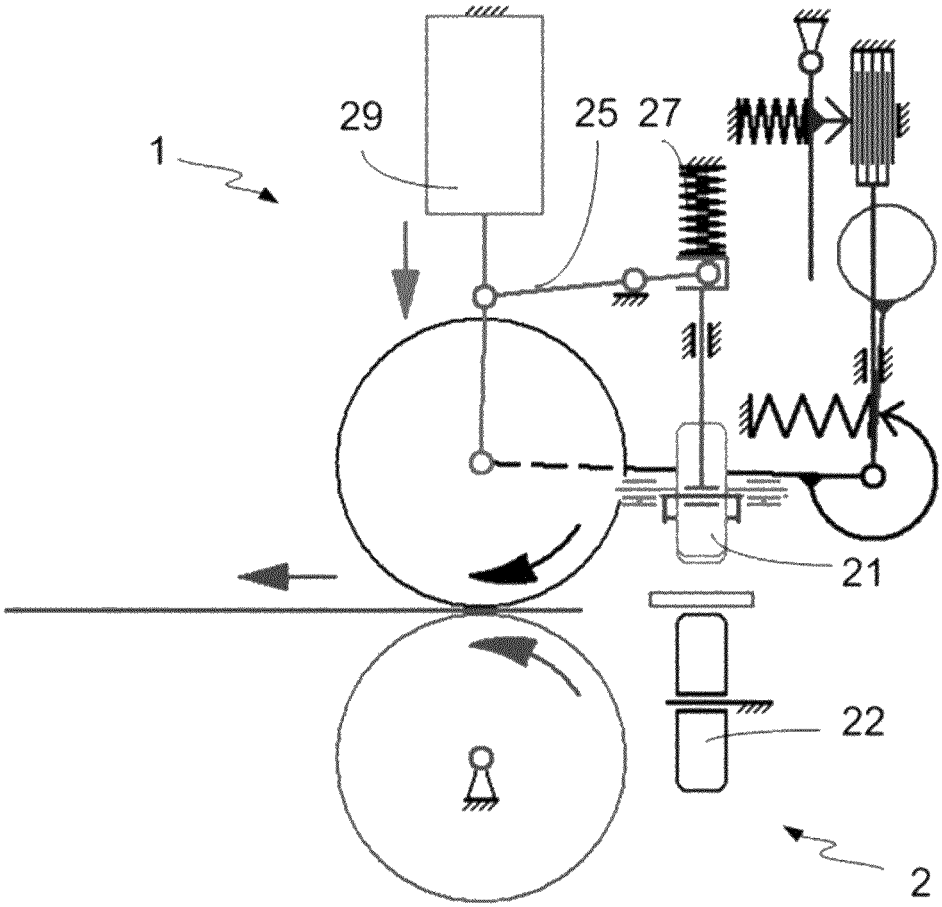
FIG. 15 is a schematic front view illustrating the third action phase of guiding rollers of FIG. 10.

When a piece of sheet material, for example a banknote BN, must be redirected by the redirecting device 1 the rollers 21 are moved simultaneously and with the same speed away from the driving belt 28 for a small time by the first actuating means and the floating rollers of the guiding device 2 clamp the piece of sheet material such that it can be redirected from the driving belt 28 as it is shown in FIGS. 12 and 13 (second action phase of the guiding rollers 21). The rollers 21 are being lifted till a banknote BN leaves the belt 28. At this stage the rollers 21 and their suspensions 23, 24 may be rotated around axes of the suspensions 23, 24 (see FIGS. 14, 15); the rotation can be reduced providing rotational joints of the suspensions movable with some friction as it is mentioned above. After the banknote leaves the belt 28 the rollers 21 are lowered by the first actuating means to the belt 28 (see FIGS. 10 and 11) and the rollers 21 are fully realigned with rollers 22 and the next piece of sheet material by the time the rollers 21 need to be lifted.

In some embodiments the processing system also comprises at least one sheet material detecting sensor generating signals for the control device which in its turn activates the appropriate actuators.

Thus, the guiding device provides self-adjustment function along with the redirecting device and sheet material can be processed in the processing device without deflections with a minimized period of time when sheet material is not guided by any rollers.

This invention is not limited to the specific embodiments disclosed herein which are intended to be illustrative and it covers all modifications and alternatives coming within the scope and spirit of the invention as defined in the attached claims.

What is claimed is:

1. A self-adjusting processing system for sheet material, the system comprising a guiding device for sheet material having a main transport and a redirecting device for sheet material having a branch transport in association with the main transport to redirect the sheet material, the redirecting device further having fixed rollers adopted to interact with the branch transport and floating members, wherein the fixed rollers and the floating members are positioned at opposite sides of the branch transport and each floating member is adopted to be aligned with appropriate fixed roller, characterizing in that the redirecting device further comprises fixing means for fixing the floating members' position relative to the fixed rollers, releasing means for releasing the floating members' position relative to the fixed rollers, and a first actuating means for moving the floating members towards the fixed rollers till the floating members engage the fixed rollers and backwards from the fixed rollers.

2. The processing system of claim 1, wherein the fixing means comprises a friction brake adopted to interact with a spring, the releasing means comprises a striker and a pusher and the first actuating means comprises a first actuator.

3. The processing system of claim 1, wherein the fixing means comprises a friction brake adopted to interact with a spring, the first actuating means comprises a first actuator and the releasing means comprises a second actuator.

4. The processing system of claim 1, wherein the fixing means and the releasing means comprise an electromagnetic friction brake.

5. The processing system of claim 1, wherein the floating members comprise floating rollers.

6. The processing system of claim 1, wherein the floating members comprise floating pads.

7. The processing system of claim 1, wherein the guiding device further comprises at least two guiding rollers connected to the first actuating means, the first actuating means being adopted to move the guiding rollers towards the main transport till the engagement with the main transport and backwards from the main transport, stabilization means configured to stabilize the relative positions of the at least two guiding rollers when they are being moved away from the main transport, and at least two support rollers, wherein the at least two guiding rollers and the support rollers are positioned at opposite sides of the main transport.

8. The processing device of claim 7, wherein the stabilization means comprises first suspensions each connecting two adjacent guiding rollers and at least one second suspension connected to the first suspensions substantially directly or at the proximity of common mass centers of every first suspension and their corresponding guiding rollers, the first suspensions and the second suspension having rotational joints substantially at their mass centers, wherein the first actuating means are connected to the guiding rollers directly or at the proximity of a common mass center of the second suspension and the first suspensions with their corresponding guiding rollers.

9. A method of processing of a piece of sheet material, the method comprising:

locating a piece of sheet material on a moving main transport of a guiding device to transport the sheet material to a branch transport of a redirecting device;

clamping the sheet material between guiding rollers and support rollers;

moving the guiding rollers away from the piece of sheet material using a first actuator and a stabilizer and clamping the piece of sheet material between floating members and fixed rollers using the first actuator to transport the piece of sheet material to a branch transport of the redirecting device;

releasing the floating members' position using a releasing mechanism;

fixing a position of the floating members using a fixing device after the floating members are realigned fully or at least partially in an accumulative way with the fixed rollers;

moving the floating members away from the fixed rollers using the first actuator; and engaging the guiding rollers with the main transport to align the guiding rollers with the support rollers.

10. The method of processing of a piece of sheet material according to claim 9, wherein before locating a piece of sheet material on the moving main transport of the guiding device to transport the sheet material to the branch transport of the redirecting device the method further comprises engaging the floating members with the fixed rollers, releasing the floating members' position to fully align the floating members with the fixed rollers and fixing the floating members' position using the fixing device; said releasing and fixing actions not performed when processing the piece of sheet material.

11. A self-adjusting processing system for sheet material, the system comprising:

a guiding device including a main transport; and a redirecting device including a branch transport, the branch transport being configured to associate with the main transport, wherein the redirecting device further includes fixed rollers and floating members, the fixed rollers being configured to interact with the branch transport, wherein the fixed rollers and the floating members are positioned at opposite sides of the branch transport and each of the floating members is configured to be aligned with a corresponding one of the fixed roller, wherein the redirecting device further includes a position fixer configured to fix a position of the floating members relative to the fixed rollers, a releaser configured to release the position of the floating members, and a first actuator configured to move the floating members towards the fixed rollers to engage the floating members to the fixed rollers and configured to move the floating members away from the fixed rollers.

12. The processing system of claim 11, wherein the position fixer includes a friction brake adopted to interact with a spring, and the releaser includes a striker and a pusher.

13. The processing system of claim 11, wherein the position fixer includes a friction brake adopted to interact with a spring, and the releaser includes a second actuator.

14. The processing system of claim 11, wherein the position fixer and the releaser include an electromagnetic friction brake.

15. The processing system of claim 11, wherein the floating members further comprise floating rollers.

16. The processing system of claim 11, wherein the floating members include floating pads.

17. The processing system of claim 11, wherein the guiding device further includes at least two guiding rollers connected to the first actuator, the first actuator being adopted to move the at least two guiding rollers to and from the main transport to engage and disengage with the main transport, a stabilizer configured to stabilize the relative positions of the at least two guiding rollers, and at least two support rollers, wherein the at least two guiding rollers and the at least two support rollers are positioned at opposite sides of the main transport.

18. The processing device of claim 17, wherein the stabilizer includes at least one first suspension connecting two adjacent guiding rollers, and at least one second suspension connecting the at least one first suspension and its corresponding guiding rollers, the at least one first suspension and the at least one second suspension having rotational joints substantially at their mass centers, wherein the first actuator is connected to the guiding rollers directly or at the proximity of a common mass center of the at least one second suspension and the at least one first suspension.

* * * * *